United States Patent [19]

Wilson

[11] 4,243,906

[45] Jan. 6, 1981

[54] HIGH PRESSURE MERCURY VAPOR DISCHARGE LAMP

[75] Inventor: Ian L. Wilson, Hanover, Fed. Rep. of Germany

[73] Assignee: U.S. Philips Corporation, New York, N.Y.

[21] Appl. No.: 917,978

[22] Filed: Jun. 22, 1978

[30] Foreign Application Priority Data

Jun. 4, 1977 [DE] Fed. Rep. of Germany ..... 2725297

[51] Int. Cl.[3] ..... H01J 61/20; H01J 61/22

[52] U.S. Cl. ..... 313/229; 313/225

[58] Field of Search ..... 313/229, 225, 227

[56] References Cited

U.S. PATENT DOCUMENTS

| | | | |
|---|---|---|---|
| 3,416,023 | 12/1968 | Eckel et al. | 313/229 X |
| 3,590,307 | 6/1971 | Dobrusskin et al. | 313/229 X |
| 3,867,665 | 2/1975 | Furmidge et al. | 313/229 X |
| 3,947,714 | 3/1976 | Rehder et al. | 313/225 |
| 4,074,164 | 2/1978 | Leyendecker | 313/229 X |

*Primary Examiner*—Palmer C. Demeo

*Attorney, Agent, or Firm*—Robert S. Smith

[57] ABSTRACT

The advantageous light-technical properties of the alkaline earth and rare earth halides can be utilized without an excessive thermal load of the wall of the vessel occurring, if the discharge vessel contains at least one halide of iron, of cobalt or of nickel as a compound-forming metal halide.

7 Claims, 3 Drawing Figures

HIGH PRESSURE MERCURY VAPOR DISCHARGE LAMP

Figure 1:
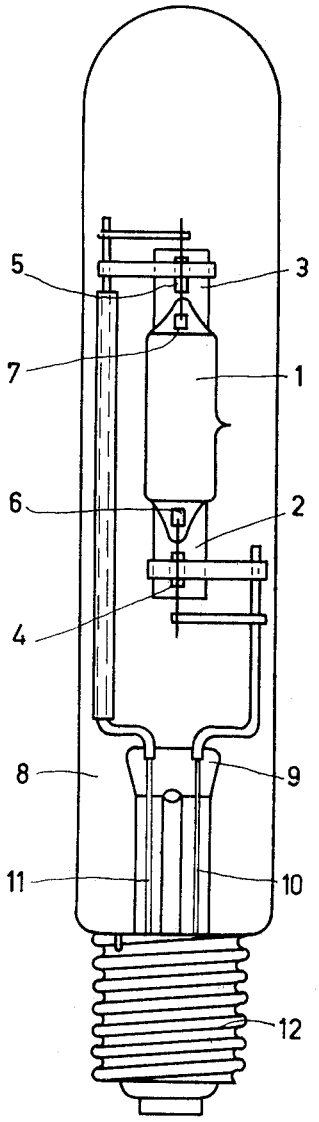

The invention relates to a high pressure mercury vapour discharge lamp having a discharge vessel on or in which means are provided for maintaining a discharge, for example electrodes or high-frequency generators. The discharge vessel contains mercury, at least one rare gas as a starting gas, at least one of the halogens iodine, bromine and chlorine, at least one of the metals calcium, strontium, barium and rare-earth metals and, possibly indium, thallium and/or alkali metals, these metals being wholly or partly in the form of their halides, the discharge vessel furthermore containing at least one metal halide capable of forming a gaseous compound with the alkaline earth metal and/or rare earth halides.

High pressure mercury vapour discharge lamps are primarily used for general lighting purposes, for example for street lighting. In addition to mercury and a rare gas they preferably contain iodine as the halogen and sodium, indium and thallium as the metals. Last-mentioned metals are excited so as to emit light while mercury serves as a buffer gas to increase the pressure but does substantially not take part in excitation and ionization processes (Philips Technical Review 29 (1968) pages 361 to 370 inclusive).

German Offenlegungsschrift No. 2,422,411 discloses a high pressure mercury vapour discharge lamp having a discharge vessel on or in which means are provided for maintaining the discharge and containing mercury, at least one rare gas at the starting gas, at least one of the halogens iodine, bromium and chlorine, at least one of the metals sodium, lithium, potassium, caesium, calcium, strontium and barium and, possibly, cadmium, gallium, indium, thallium, tin, scandium, yttrium and rare earth metals, these metals being wholly or partly in the form of their halides, the discharge vessel containing, in addition, at least one highly volatile halide, preferably a halide of the element aluminium, which is capable of forming a gaseous compound with the poorly volatile alkali metal and alkaline earth metal halides. Alternatively, the discharge vessel may contain, in addition, halides of the trivalent iron. In this manner an increase in the luminous efficiency is obtained without the necessity of increasing the thermal load of the wall of the vessel. So a solution is provided for the problem caused by the poor volatility, especially of the alkali metal and earth alkaline metal halides, the problem being that in normal circumstances an insufficient quantity of halide in the vapor state is present. Namely, the formation of the gaseous compound furnishes an increase in the effective partial pressure of the poorly volatile compound at a predetermined wall temperature.

The choice of the metals suitable for use as radiators in high pressure mercury vapor discharge lamps is, however, always adversely affected by the poor volatility of the corresponding metal halides. The vapor pressures of the halides of the alkaline earth metals (calcium, strontium, barium) and especially the pressures of rare earth metals, which preferably form dihalides instead of trihalides (for example samarium, europium, ytterbium), are particularly low, this being, in particular, a reason that these elements have hitherto not been used in normal commercially available lamps, although it might be expected that they have partly excellent light technical properties.

French Patent Specification No. 1,489,754 discloses a lamp in which the poor volatility of alkaline earth metal and rare earth metal halides must be remedied by halogen hydrocarbons, for example ethylenebromide, by forming metal organic compounds. This lamp has the drawback that the organic compounds decompose already the first time the lamp is started. This results in soot formation.

U.S. Pat. No. 3,771,009 discloses an electric discharge lamp whose filling contains a highly volatile complex defined by the formula Ln $M_xI_{3x+3}$ where Ln represents a rare earth metal, inter alia also samarium, europium and ytterbium, M represents boron, aluminium, gallium and indium and $x=3$ to 4. This lamp has the drawback of having a low luminous efficiency. Furthermore, reaction of $AlI_3$ with the wall of the vessel results in greying of the wall.

German Offenlegungsschrift No. 1,801,834 discloses ultraviolet irradiation devices for therapeutic purposes having a high pressure mercury discharge burner, containing cobaltchloride or an iron-(II)-halide. However, these burners contain neither alkaline earth metals nor rare earth halides, so that no complex formation can occur. In addition, these lamps emit predominantly in the blue-violet, while for the invention visible radiation is the essential thing.

It is an object of the invention to provide a high pressure mercury vapour discharge lamp by means of which the proper light-technical properties of the alkaline earth halides and rare earth halides are utilised without an excessive thermal load on the wall of the vessel.

In accordance with the invention a discharge lamp of the kind described in the preamble is characterized in that the discharge vessel contains at least one halide of iron, of cobalt or of nickel as the compound-forming metal halide.

Preferably the discharge vessel comprises the compound-forming halides in quantities of from 0.1 to 10 mole per mole of the alkaline earth metal halides and rare earth halides, respectively.

By way of rare earth metals the discharge vessel preferably contains those rare earth metals which preferably form dihalides instead of trihalides, so bivalent rare earth metals, samarium, europium and/or ytterbium in particular.

Cobalt and nickel are used in the bivalent state, because only this state has a real technical meaning in practice. Iron is preferably used in the bivalent state.

However, the operation envisaged by the invention is also obtained by the addition of iron-(III)-halides. This can, however, also be attributed to the action of iron-(II)-halides because the trivalent iron is reduced to bivalent iron by the lamp materials mercury (filling) and tungsten (electrodes), respectively.

The invention is based on thermodynamic considerations in accordance with which the formation of a complex between a non-volatile or a poorly volatile compound and a volatilizing agent results in an increase in the vapour pressure, if the volatilizing agent forms stable dimers and is itself a volatile compound. Furthermore it was found that the increase in the vapour pressure is greater when the non-volatile or poorly volatile compound is less volatile.

The dihalides of iron, cobalt and nickel form relatively stable dimers and are of a moderate volatility.

From experiments resulting in the invention, it appeared that the addition of these compounds to alkaline earth or rare earth-(II)-halides resulted in an increase in the vapor pressure by a factor of 10 to 50 at 1000 K. This action can be explained by the formation of 1:2 complexes (for example $CaI_2.2\ FeI_2$).

In lamps the increased effective vapor pressure results in an increase of the emission of the alkaline earth and the rare earth metal element, respectively. Positive results were observed for all halide combinations (chlorine, bromine, iodine), the best results, however, were furnished by chlorine-iodine mixtures. The positive effects are most obvious with the calcium, strontium and ytterbium systems which owe their radiant properties for the major part to the emission of monohalide molecules (CaX, SrX, YbX, where X=halogen). Particularly interesting is the intense green molecular radiation generated in lamps, containing ytterbium-halide complexes.

The systems according to the invention can be combined with one another or with other metal halides, for example with sodium, caesium, lithium, indium and/or thallium halides, to improve colour aspects, luminous efficiency, electric properties etc.

Embodiments of the invention will now be further described with reference to a drawing and several examples.

Figure 2:
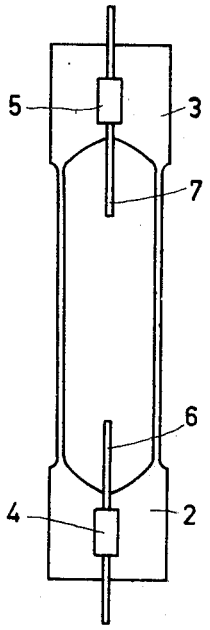
Figure 3:
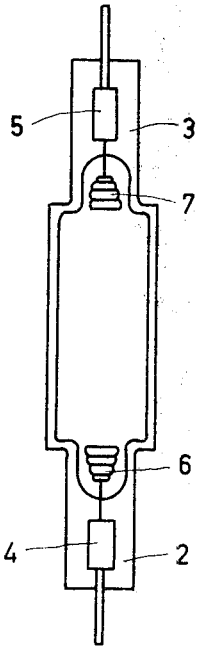

FIG. 1 shows an embodiment of a high pressure mercury vapour discharge lamp according to the invention, FIG. 2 shows an embodiment of a discharge vessel for a lamp as shown in FIG. 1, and FIG. 3 shows another embodiment of the discharge vessel.

Referring now to FIG. 1, reference numeral 1 denotes a quartz glass discharge vessel of a lamp according to the invention which, in operation, consumes a power of approximately 400 W. At either end of the discharge vessel 1 a pinch 2 and 3, respectively, is formed in which current supply elements 4 and 5 are sealed. In the discharge vessel the current supply elements are connected to tungsten electrodes 6 and 7 between which the discharge is produced in operation. The discharge vessel 1 is enclosed in an outer envelope 8 which is made, for example, of hard glass, is evacuated or filled with an inert gas and has at one end a pinch 9 through which the current supply wires 10 and 11 are passed in a vacuum-tight manner. These current supply wires 10 and 11 are connected to the current supply elements 4 and 5 and also serve as support wires for the discharge vessel. The current supply wires 10 and 11 are also connected to contacts of a lamp base 12. The discharge vessel shown in FIG. 2 has pointed electrodes 6 and 7, whereas in the discharge vessel shown in FIG. 3 the electrodes 6 and 7 are helically wound. In addition, the inner space of the discharge vessel shown in FIG. 2 is oval, that of the vessel shown in FIG. 3 being cylindrical. The remaining reference numerals in FIGS. 2 and 3 have the same meaning as in FIG. 1.

In the following examples discharge vessels were used which had the following dimensions:

electrode spacing: 40 mm
inner diameter: 15.5 mm
volume FIG. 2: 11.5 $cm^3$
FIG. 3: 7.3 $cm^3$.

In the discharge vessels the lower electrode space was provided with a heat reflector (not shown) which was required to raise the temperature of this space to a value corresponding to a wall temperature of between 700° C. and 800° C.

EXAMPLES

All lamps were of the shape shown in FIG. 3 and contained, in addition to the halides, 30 mg of mercury and 20 Torr argon as the starting gas. The electrodes are not activated. The outer walls of the electrode spaces are coated with zirconium dioxide to increase the temperature. The lamps were operated in a vertical position in an evacuated outer bulb.

Examples (1) to (6) inclusive: technical data of the lamps containing alkaline earth and rare earth-(II)-halide, respectively, /iron, cobalt, and nickel (II)-halide, respectively, as the fill.

Examples (7) and (8): technical data of lamps, containing $CaI_2/FeCl_3$ and $YbI_2/FeCl_3$, respectively, as the fill.

Examples (9) to (16) inclusive: technical data of lamps containing alkaline earth or rare earth (II)-complex halide systems and additional metal halides as the fill.

The following examples show
the power in Watts
the current strength in amperes
the voltage in volts and
the light efficiency in lumen per Watt.

(1)
25 mg $YbI_2$, 9.5 mg $FeI_2$
500 W, 3.5 A, 175 V, 50.4 lm/W (2)
25 mg $YbI_2$, 4 mg $FeCl_2$
500 W, 3.45 A, 175 V, 64.3 lm/W (3) 25 mg $YbI_2$, 4 mg $CoCl_2$
500 W, 3.85 A, 160 V, 61.4 lm/W (4)
25 mg $YbI_2$, 4 mg $NiCl_2$
500 W, 3.90 A, 155 V, 59.4 lm/W (5)
27 mg $CaI_2$, 6 mg $FeCl_2$
500 W, 2.10 A, 295 V, 61.6 lm/W (6)
31 mg $SrI_2$, 6 mg $FeCl_2$
500 W, 2.50 A, 240 V, 44.3 lm/W (7)
17 mg $CaI_2$, 5 mg $FeCl_3$
500 W, 3.00 A, 225 V, 66.0 lm/W (8)
25 mg $YbI_2$, 5 mg $FeCl_3$ 500 W, 3.28 A, 220 V, 63.8 lm/W (9)
40 mg $YbI_2$, 25 mg NaI, 6 mg $FeCl_2$
500 W, 4.12 A, 145 V, 92.8 lm/W

(10)
25 mg $YbI_2$, 25 mg NaI, 4 mg $CoCl_2$
500 W, 3.94 A, 153 V, 88.7 lm/W

(11)
25 mg $EuI_2$, 25 mg NaI, 4 mg $FeCl_2$
500 W, 3.90 A, 160 V, 74.2 lm/W

(12)
25 mg $CaI_2$, 6 mg TlI, 6 mg $FeCl_2$
500 W, 3.55 A, 166 V, 76.3 lm/W

(13)
25 mg $YbI_2$, 6.5 mg CsCl, 4 mg $FeCl_2$
500 W, 4.05 A, 138 V, 51.5 lm/W

(14)
40 mg $YbI_2$, 10 mg NaCl, 6 mg $FeCl_2$

500 W, 3.68 A, 162 V, 104.7 lm/W (15)

40 mg $YbI_2$, 10 mg NaCl, 6 mg $CoCl_2$

500 W, 4.27 A, 144 V, 107.2 lm/W

(16) 40 mg $YbI_2$, 25 mg NaI, 15 mg $FeI_2$

500 W, 3.63 A, 168 V, 89.5 lm/W.

What is claimed is:

1. A high pressure mercury vapor discharge lamp which comprises: a discharge vessel and means for maintaining the discharge in said vessel, said discharge vessel containing mercury, at least one rare gas as a starting gas, at least one of the halogens iodine, bromine and chlorine, at least one of the metals selected from the group consisting of calcium, strontium, barium and the rare earth metals, each of said metals being wholly or partly in the form of their halides, said discharge vessel containing in addition at least one metal halide selected from the group consisting of the halides of iron, of cobalt and of nickel.

2. A high pressure mercury vapor discharge lamp as claimed in claim 1, wherein said discharge vessel contains said additional halide in quantities of 0.1 to 10 mole per mole of the alkaline earth metal and rare earth halides respectively present in said discharge vessel.

3. A high pressure mercury vapor discharge lamp as claimed in claim 1, wherein said discharge vessel contains a bivalent rare earth metal selected from the group consisting of samarium, europium and ytterbium.

4. A high pressure mercury vapor discharge lamp as claimed in claim 1 wherein said additional halides are selected from the group consisting of halides of bivalent iron, of bivalent cobalt and of bivalent nickel.

5. A high pressure mercury vapor discharge lamp as claimed in claim 1 wherein said additional halide is a halide of trivalent iron.

6. A high pressure mercury vapor discharge lamp as claimed in claim 1 wherein both halogens chlorine and iodine are disposed in said vessel.

7. A high pressure mercury vapor discharge lamp as claimed in claim 1 wherein the discharge vessel furthermore contains at least one metal selected from the group consisting of indium, thallium and the alkali metals, each of said metals being wholly or partly in the form of their halides.

* * * * *